US010022575B2

(12) United States Patent
Bosma

(10) Patent No.: US 10,022,575 B2
(45) Date of Patent: Jul. 17, 2018

(54) ANTIFREEZE SPRINKLER SYSTEM

(71) Applicant: The Viking Corporation, Hastings, MI (US)

(72) Inventor: Michael J. Bosma, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 427 days.

(21) Appl. No.: 14/528,558

(22) Filed: Oct. 30, 2014

(65) Prior Publication Data

US 2015/0265861 A1 Sep. 24, 2015

Related U.S. Application Data

(60) Provisional application No. 61/955,381, filed on Mar. 19, 2014.

(51) Int. Cl.

| | |
|---|---|
| ***A62C 35/00*** | (2006.01) |
| ***A62C 35/64*** | (2006.01) |
| ***A62C 35/60*** | (2006.01) |
| ***A62C 3/00*** | (2006.01) |

(52) U.S. Cl.

CPC ..... *A62C 35/64* (2013.01); *A62C 3/004* (2013.01); *A62C 35/60* (2013.01)

(58) Field of Classification Search

CPC ..... A62C 5/008; A62C 35/64; A62C 35/60
USPC ..... 169/16–19
See application file for complete search history.

(56) References Cited

U.S. PATENT DOCUMENTS

| | | | | |
|---|---|---|---|---|
| 7,055,612 | B2 * | 6/2006 | Jackson | A62C 35/68 169/16 |
| 7,389,824 | B2 | 6/2008 | Jackson | |
| 7,798,239 | B2 | 9/2010 | Golinveaux et al. | |
| 2011/0127049 | A1 * | 6/2011 | Long | A62C 35/62 169/16 |
| 2012/0298382 | A1 | 11/2012 | Shipman | |
| 2013/0341055 | A1 * | 12/2013 | Kochelek | A62C 37/00 169/46 |

OTHER PUBLICATIONS

NFPA 13, 2007 Edition, p. 13-39.*
Automatic Sprinkler Systems Handbook, NFPA 13, Tenth Edition; Dubay, P.E., Christian (p. 185-195).

* cited by examiner

*Primary Examiner* — Alexander Valvis
(74) *Attorney, Agent, or Firm* — Harness, Dickey & Pierce, P.L.C.

(57) ABSTRACT

An antifreeze fire protection sprinkler system is provided including a water supply and a water distribution pipe system having a plurality of segments disposed in a potentially freezing environment and having a check valve and a plurality of fire protection sprinklers disposed in each segment wherein the plurality of fire protection sprinklers are designed to limit the atomization of the antifreeze solution. A pressure regulating device is disposed in the water distribution pipe system for limiting a maximum pressure of water supplied to the water distribution pipe system.

7 Claims, 1 Drawing Sheet

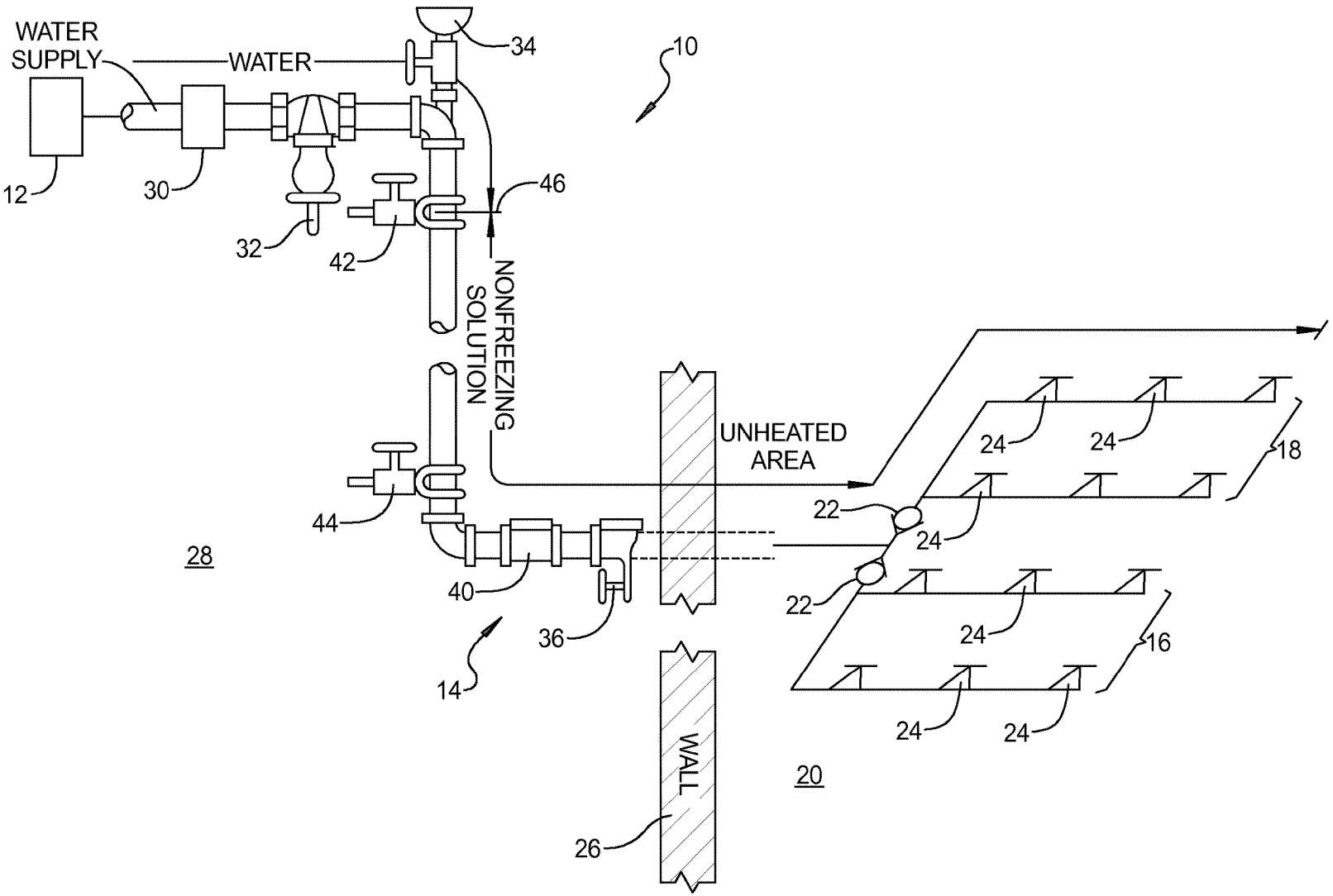
10
WATER SUPPLY
12
WATER
30
32
34
46
NONFREEZING SOLUTION
42
44
28
40
36
14
UNHEATED AREA
22
22
24
24
24
24
24
24
18
16
20
WALL
26

ANTIFREEZE SPRINKLER SYSTEM

CROSS-REFERENCE TO RELATED APPLICATIONS

This application claims the benefit of U.S. Provisional Application No. 61/955,381, filed on Mar. 19, 2014. The entire disclosure of the above application is incorporated herein by reference.

FIELD

The present disclosure relates to an antifreeze sprinkler system for use in un-heated or potentially freezing environments.

BACKGROUND

This section provides background information related to the present disclosure which is not necessarily prior art.

Antifreeze sprinkler systems are often used as subsystems of a wet pipe sprinkler system. These systems are intended to protect small areas that could be exposed to freezing temperatures, such as outside loading docks. Antifreeze systems are also used for larger areas, such as freezers, as well as for residential areas that are not protected against freezing temperatures.

In an antifreeze system, the pipes within the unheated area that are subject to potential freezing are filled with an antifreeze solution, such as propylene glycol or glycerin which has been mixed with water. Mixtures of up to 60 percent antifreeze and 40 percent water are known in the art. Over the last several years, there have been fires in which an antifreeze system was involved that have caused the fire protection industry standards and approval bodies to rethink the viability of the antifreeze fire protection systems. This work is resulting in code activities that will eliminate or severely limit a very popular way to address sprinkler systems installed in cold areas. The percentage mixture is being limited to unusable amounts that are impractical in the industry. Accordingly, it is desirable in the fire protection industry to define workable parameters for use of antifreeze systems that adequately protect the system from freezing at low temperatures and that do not present any additional hazard when the fire protection system is activated and the antifreeze solution is released from the sprinklers.

SUMMARY

This section provides a general summary of the disclosure, and is not a comprehensive disclosure of its full scope or all of its features.

The system of the present application has designed an antifreeze system which provides pressure limitations to the water that is delivered through the sprinklers as well as orifice size and deflector design limitations that limit the atomization of the solution that is expelled from the sprinklers. The overall volume of antifreeze solution that is discharged initially from the sprinkler system is also limited.

According to the principles of the present disclosure, an antifreeze fire protection sprinkler system is provided including a water supply and a water distribution pipe system connected to the water supply and having a plurality of segments disposed in a potentially freezing environment and having a check valve and a plurality of fire protection sprinklers disposed in each segment. Each segment is filled with an antifreeze solution including a mixture of at least 40 percent water and up to 60 percent of one of propylene, glycol, and glycerin. The plurality of fire protection sprinklers include a deflector and an orifice size designed to avoid atomizing the antifreeze solution into drop sizes suitable for the potential of the antifreeze solution becoming a fuel for fire. A pressure regulating device is disposed in the water distribution pipe system for limiting a maximum pressure of water supplied to the water distribution pipe system. A volume of each of the plurality of segments is recommended not to exceed 40 gallons so that the overall volume of antifreeze that is initially dispersed on the fire can be limited. A maximum pressure allowed by the pressure regulating device can be set not to exceed 50 PSI so as not to contribute to the atomizing of the antifreeze solution. It is intended that the sprinklers have a K-factor of up to 8 for residential use and up to, and even greater than, 25 for storage and commercial use.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The FIGURE is a schematic diagram of an antifreeze fire protection sprinkler system according to the principles of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

With reference to the accompanying FIGURE, an antifreeze fire protection sprinkler system 10 will now be described. The antifreeze fire protection sprinkler system 10 includes a water supply 12 and a water distribution pipe system 14 that is connected to the water supply. The water distribution pipe system 14 can include a plurality of segments 16, 18 that are disposed in a potentially freezing environment 20. Each of the plurality of segments can be provided with a check valve 22 and a plurality of fire protection sprinklers 24. A wall 26 can separate the unheated area 20 or refrigerated or freezing area from another area 28 that is generally kept at temperatures that are above freezing.

The water distribution piping system is provided with a pressure regulating device 30 that can be utilized for limiting the maximum pressure of the water supply to the water distribution system. According to the present example, it is believed that pressures of up to and less than 50 PSI significantly reduce the risk of atomizing the antifreeze solution into drop sizes suitable for the antifreeze solution becoming a fuel for a fire. The water distribution system piping can also include an approved indicating valve 32, a antifreeze solution filling cup 34, and a drain valve 36 as are known in antifreeze systems. It is understood in the art that the drain valve 36 is located at the lowest most point of the system so that the solution that is filled within the water distribution pipe system 14 is all pitched so that the water can drain back to the drain valve 36. In some systems, a check valve 40 can be located in the pipe distribution system in order to prevent and/or reduce back flow of the antifreeze solution into the water supply 12.

The water distribution pipe system 14 employs the check valves 22 that separate the segments 16, 18 of the sprinkler lines from one another so that the volume of potential solution discharged through any sprinkler 24 can be limited to the amount of solution that is in the individual segment 16, 18 in addition to the upstream lines. Accordingly, the volume of antifreeze solution in the other segments 16, 18 that have not been activated would be isolated from passing through the activated sprinkler 24. It is noted that the system can also be provided with spigot valves 42 and 44 that allow the testing of the antifreeze solution by releasing a necessary amount of the solution through the valve 44 so that the solution can be tested for its proper concentration. The valve 42 can be utilized to make sure that the level of the antifreeze solution does not exceed the level of the line indicated at 46.

The plurality of fire protection sprinklers 24 can have a K-factor of at least 3 and up to 8 for residential applications, while for storage and commercial applications a K-factor of 25 or even greater can be used. The sprinklers are designed to provide water droplets at pressures not exceeding 50 psi to avoid atomizing the antifreeze solution into drop sizes suitable for the potential of the antifreeze solution becoming a fuel for a fire.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antifreeze fire protection sprinkler system, comprising:

a water supply;

a water distribution pipe system connected to the water supply and having a plurality of segments and having a check valve and a plurality of fire protection sprinklers disposed in each segment;

a pressure regulating device disposed in said water distribution pipe system for limiting a maximum pressure of water supplied to the water distribution pipe system to no greater than 50 psi; and an antifreeze solution of greater than 50 percent and up to 60 percent of one of propylene glycol and glycerin and at least 40 percent water disposed in said water distribution pipe system.

2. The antifreeze fire protection sprinkler system according to claim 1, wherein a volume of each of said plurality of segments does not exceed 40 gallons.

3. The antifreeze fire protection sprinkler system according to claim 1, wherein said maximum pressure is no greater than 40 psi.

4. The antifreeze fire protection sprinkler system according to claim 1, wherein said plurality of fire protection sprinklers have a K-factor of at least 3.0.

5. An antifreeze fire protection sprinkler system, comprising:

a water supply;

a water distribution pipe system having a plurality of fire protection sprinklers;

a pressure regulating device disposed in said water distribution pipe system for limiting a maximum pressure of water supplied to the water distribution pipe system at no greater than 50 psi; and an antifreeze solution of greater than 50 percent and up to 60 percent of one of propylene, glycol, and glycerin, and at least 40 percent water disposed in said water distribution pipe system.

6. The antifreeze fire protection sprinkler system according to claim 5, wherein said maximum pressure is no greater than 40 psi.

7. The antifreeze fire protection sprinkler system according to claim 5, wherein said plurality of fire protection sprinklers have a K-factor of at least 3.0.

* * * * *